US011725668B2

(12) United States Patent
Iwakiri et al.

(10) Patent No.: US 11,725,668 B2
(45) Date of Patent: Aug. 15, 2023

(54) CENTRIFUGAL COMPRESSOR AND TURBOCHARGER

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Isao Tomita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 140 days.

(21) Appl. No.: 17/435,876

(22) PCT Filed: Mar. 19, 2019

(86) PCT No.: PCT/JP2019/011539
§ 371 (c)(1),
(2) Date: Sep. 2, 2021

(87) PCT Pub. No.: WO2020/188765
PCT Pub. Date: Sep. 24, 2020

(65) Prior Publication Data
US 2022/0145903 A1 May 12, 2022

(51) Int. Cl.
*F04D 29/46* (2006.01)
*F04D 17/10* (2006.01)
(Continued)

(52) U.S. Cl.
CPC ..... *F04D 29/464* (2013.01); *F04D 17/10* (2013.01); *F04D 27/0253* (2013.01);
(Continued)

(58) Field of Classification Search
CPC .... F04D 29/464; F04D 17/10; F04D 27/0253; F04D 29/441; F04D 25/024; F05D 2220/40; F05D 2250/51
See application file for complete search history.

(56) References Cited

U.S. PATENT DOCUMENTS 9,777,640 B2 10/2017 Mohtar et al.
2015/0192147 A1 7/2015 An et al.
(Continued)

FOREIGN PATENT DOCUMENTS

EP 1947299 A2 7/2008
EP 3051099 A1 8/2016
(Continued)

OTHER PUBLICATIONS

International Preliminary Report on Patentability and Written Opinion of International Searching Authority (Forms PCT/IB/338, PCT/IB/373, PCT/ISA/237) for International Application No. PCT/JP2019/011539, dated Sep. 30, 2021, with English translation of the Written Opinion.
(Continued)

*Primary Examiner* — Mickey H France
*Assistant Examiner* — Edward Bushard
(74) *Attorney, Agent, or Firm* — Birch, Stewart, Kolasch & Birch, LLP

(57) ABSTRACT

A centrifugal compressor includes: an impeller; an inlet pipe portion forming an intake passage to introduce air to the impeller; and a throttle mechanism capable of reducing a flow passage area of the intake passage upstream of the impeller. The throttle mechanism includes an annular por-
(Continued)

tion configured to move between a first position and a second position upstream of the first position in an axial direction of the impeller, and a strut supporting the annular portion. The strut extends toward at least one of an outer side in a radial direction of the impeller or a downstream side in the axial direction of the impeller with an increase in distance from the annular portion.

15 Claims, 16 Drawing Sheets

(51) Int. Cl.
*F04D 27/02* (2006.01)
*F04D 29/44* (2006.01)

(52) U.S. Cl.
CPC ..... *F04D 29/441* (2013.01); *F05D 2220/40* (2013.01); *F05D 2250/51* (2013.01)

(56) References Cited

U.S. PATENT DOCUMENTS

| | | | |
|---|---|---|---|
| 2016/0131145 | A1 | 5/2016 | Mohtar et al. |
| 2016/0146099 | A1 | 5/2016 | Mohtar et al. |
| 2017/0298943 | A1 | 10/2017 | Mohtar et al. |

FOREIGN PATENT DOCUMENTS

| | | | |
|---|---|---|---|
| JP | 4-311633 | A | 11/1992 |
| JP | 5-38397 | U | 5/1993 |
| JP | 2000-87752 | A | 3/2000 |
| JP | 2013-2349 | A | 1/2013 |
| JP | 5223642 | B2 | 6/2013 |
| JP | 5824821 | B2 | 12/2015 |
| JP | 2018-131986 | A | 8/2018 |
| WO | WO 2014/030248 | A1 | 2/2014 |

OTHER PUBLICATIONS

International Search Report for International Application No. PCT/JP2019/011539, dated Jun. 25, 2019.

CENTRIFUGAL COMPRESSOR AND TURBOCHARGER

TECHNICAL FIELD

The present disclosure relates to a centrifugal compressor and a turbocharger.

BACKGROUND ART

In recent years, for widening the operating range and improving efficiency at the operating point on the low flow rate side (near the surge point) of a centrifugal compressor, it has been proposed to install a throttle mechanism (inlet variable mechanism) at the inlet pipe portion of the centrifugal compressor, as described in Patent Document 1, for example.

At the low flow rate operating point of the centrifugal compressor, backflow tends to occur on the tip side of the impeller blades. The throttle mechanism described in Patent Document 1 has an annular portion disposed in the intake passage to suppress the backflow, and reduces the flow passage area of the intake passage upstream of the impeller by blocking an outer peripheral portion of the intake passage corresponding to the tip side of the impeller blades. When the flow passage area of the intake passage is reduced, although the peak efficiency is reduced due to the reduced area, it is possible to reduce the surge flow rate and improve the efficiency near the surge point. In other words, by performing a variable control to increase the flow passage area of the intake passage during operation on the high flow rate side and to reduce the flow passage area of the intake passage during operation on the low flow rate side, it is possible to achieve wide range and improved efficiency at the operating point on the low flow rate side. This indicates that the impeller blade height is lowered (trimmed) to be adapted to the low flow rate operating point artificially, which is called variable inlet compressor (VIC) or variable trim compressor (VTC).

CITATION LIST

Patent Literature

Patent Document 1: U.S. Pat. No. 9,777,640B

SUMMARY

Problems to be Solved

Patent Document 1 discloses, as one throttle mechanism, a system of adjusting the flow passage area of the intake passage by moving the annular portion between the first position and the second position upstream of the first position in the axial direction of the impeller.

In this type of system, a driving force needs to be transmitted to the annular portion to move the annular portion between the first position and the second position. However, Patent Document 1 does not describe a configuration for transmitting a driving force to the annular portion, and does not disclose any findings for simplifying the configuration.

In view of the above, an object of at least one embodiment of the present invention is to provide a centrifugal compressor that can improve the efficiency at the low flow rate operating point with a simple configuration, and a turbocharger including the same.

Solution to the Problems (1) A centrifugal compressor according to at least one embodiment of the present invention comprises: an impeller; an inlet pipe portion forming an intake passage to introduce air to the impeller; and a throttle mechanism capable of reducing a flow passage area of the intake passage upstream of the impeller. The throttle mechanism includes an annular portion disposed in the intake passage, and a strut supporting the annular portion and configured to move the annular portion between a first position and a second position upstream of the first position in an axial direction of the impeller. The strut extends toward at least one of an outer side in a radial direction of the impeller or a downstream side in the axial direction of the impeller with an increase in distance from the annular portion.

With the centrifugal compressor described in the above (1), by reducing the flow passage area of the intake passage by the throttle mechanism upstream of the impeller, it is possible to achieve a higher efficiency at the low flow rate operating point. Further, compared to the configuration in which the strut extends upstream in the axial direction from the annular portion, the length of the strut is reduced, so that the configuration can be simplified, and the increase in pressure loss due to the strut in the intake passage can be suppressed.

(2) In some embodiments, in the centrifugal compressor described in the above (1), an inner peripheral surface of the inlet pipe portion includes an inclined surface that is inclined such that an inner diameter of the inlet pipe portion increases upstream in the axial direction.

With the centrifugal compressor described in the above (2), the increase in pressure loss due to the installation of the annular portion can be suppressed.

(3) In some embodiments, in the centrifugal compressor described in the above (2), an outer peripheral surface of the annular portion is separated from the inclined surface when the annular portion is in the second position. A distance between the annular portion and the inclined surface decreases as the annular portion moves downstream in the axial direction from the second position.

With the centrifugal compressor described in the above (3), by moving the annular portion downstream from the second position, the flow passage area of the outer peripheral portion of the intake passage can be reduced. Accordingly, it is possible to effectively improve the efficiency at the low flow rate operating point with a simple configuration.

(4) In some embodiments, in the centrifugal compressor described in the above (2) or (3), an outer peripheral surface of the inlet pipe portion includes an inclined surface that is inclined such that an outer diameter of the inlet pipe portion increases upstream in the axial direction.

With the centrifugal compressor described in the above (4), since the flow passage area of the intake passage increases upstream, the increase in pressure loss due to the annular portion can be suppressed. Further, a space between the inclined surface of the outer peripheral surface of the inlet pipe portion and the diffuser portion or a space between the inclined surface and the scroll portion can be effectively used as the space for installing the actuator for moving the annular portion. Consequently, it is possible to prevent the enlargement of the centrifugal compressor due to the installation of the throttle mechanism.

(5) In some embodiments, in the centrifugal compressor described in the above (4), the strut includes a downstream extension portion extending downstream in the axial direction with an increase in distance from the annular portion.

With the centrifugal compressor described in the above (5), compared to the configuration in which the strut extends upstream in the axial direction from the annular portion, the length of the strut is reduced, so that the configuration can be simplified, and the increase in pressure loss due to the passage extension portion in the intake passage can be suppressed. Further, when the downstream extension portion extends to a space between the inclined surface of the outer peripheral surface of the inlet pipe portion and the diffuser portion of the centrifugal compressor or a space between the inclined surface and the scroll portion of the centrifugal compressor, this space can be effectively used as the space for installing the actuator for moving the annular portion. Consequently, it is possible to prevent the enlargement of the centrifugal compressor due to the installation of the throttle mechanism.

(6) In some embodiments, in the centrifugal compressor described in the above (5), the strut extends to a space between the inclined surface of the outer peripheral surface of the inlet pipe portion and a diffuser portion of the centrifugal compressor, or to a position between the inclined surface of the outer peripheral surface of the inlet pipe portion and a scroll portion of the centrifugal compressor.

With the centrifugal compressor described in the above (6), a space between the inclined surface of the outer peripheral surface of the inlet pipe portion and the diffuser portion of the centrifugal compressor or a space between the inclined surface and the scroll portion of the centrifugal compressor can be effectively used as the space for installing the actuator for moving the annular portion. Consequently, it is possible to prevent the enlargement of the centrifugal compressor due to the installation of the throttle mechanism.

(7) In some embodiments, in the centrifugal compressor described in any one of the above (1) to (6), the strut includes an outer extension portion extending outward in the radial direction with an increase in distance from the annular portion. The outer extension portion includes a passage extension portion facing the intake passage.

With the centrifugal compressor described in the above (7), compared to the configuration in which the strut extends upstream in the axial direction from the annular portion, the length of the strut is reduced, so that the configuration can be simplified, and the increase in pressure loss due to the passage extension portion in the intake passage can be suppressed.

(8) In some embodiments, in the centrifugal compressor described in the above (7), in a cross-section perpendicular to the radial direction, $a>b$ is satisfied, where a is a distance between a leading edge of the passage extension portion and a trailing edge of the passage extension portion, and b is a thickness of the passage extension portion in a direction perpendicular to a straight line connecting the leading edge and the trailing edge.

With the centrifugal compressor described in the above (8), the increase in pressure loss due to the passage extension portion can be suppressed.

(9) In some embodiments, in the centrifugal compressor described in the above (7) or (8), a thickness of a leading edge portion of the passage extension portion decreases upstream in the axial direction.

With the centrifugal compressor described in the above (9), the increase in pressure loss due to the flow impinging on the leading edge portion of the passage extension portion can be suppressed.

(10) In some embodiments, in the centrifugal compressor described in any one of the above (7) to (9), a thickness of a trailing edge portion of the passage extension portion decreases downstream in the axial direction.

With the centrifugal compressor described in the above (10), the increase in pressure loss caused on the back side of the trailing edge portion of the passage extension portion can be suppressed.

(11) In some embodiments, in the centrifugal compressor described in any one of the above (7) to (10), the passage extension portion has an airfoil shape in a cross-section perpendicular to the radial direction.

With the centrifugal compressor described in the above (11), air can smoothly flow along the passage extension portion.

(12) In some embodiments, in the centrifugal compressor described in any one of the above (7) to (11), in a cross-section perpendicular to the radial direction, a straight line connecting a leading edge of the passage extension portion and a trailing edge of the passage extension portion is inclined downstream in a rotation direction of the impeller as going downstream in the axial direction.

The flow may flow into the inlet pipe portion of the centrifugal compressor with pre-swirl. In this case, the passage extension portion designed such that the straight line is parallel to the axial direction leads to the increase in pressure loss, and it is thus desirable to incline the straight line as described above along the direction of flow with pre-swirl.

Further, even if the flow flows in the axial direction to the inlet pipe portion of the centrifugal compressor, it may be better to impart pre-swirl to the flow to improve the impeller performance. In this case, if the straight line connecting the leading edge and the trailing edge of the passage extension portion is inclined as described above, the passage extension portion functions as an inlet guide vane, and the flow is deflected by the passage extension portion to have pre-swirl. As a result, it is possible to improve the performance of the impeller.

(13) In some embodiments, in the centrifugal compressor described in any one of the above (7) to (12), in a cross-section perpendicular to the radial direction, when CL is a center line connecting a leading edge of the passage extension portion and a trailing edge of the passage extension portion and passing through a center position of a thickness of the passage extension portion, an angle between the center line CL and the axial direction at a position of the trailing edge of the passage extension portion is greater than an angle between the center line CL and the axial direction at a position of the leading edge of the passage extension portion.

With the centrifugal compressor described in the above (13), the flow direction (incidence angle) relative to the passage extension portion can be optimized, and pre-swirl can be effectively imparted to the flow in the inlet pipe portion.

(14) In some embodiments, in the centrifugal compressor described in any one of the above (7) to (12), in a cross-section perpendicular to the radial direction, when CL is a center line connecting a leading edge of the passage extension portion and a trailing edge of the passage extension portion and passing through a center position of a thickness of the passage extension portion, an angle between the center line CL and the axial direction at a position of the trailing edge of the passage extension portion is smaller than an angle between the center line CL and the axial direction at a position of the leading edge of the passage extension portion.

With the centrifugal compressor described in the above (14), undesirable pre-swirl of the flow in the inlet pipe portion can be reduced.

(15) In some embodiments, in the centrifugal compressor described in any one of the above (1) to (14), the inlet pipe portion includes a bend pipe portion configured to bend a flow in the intake passage. The strut is configured to move the annular portion between the first position and the second position along an inclination direction of an inner wall surface of the bend pipe portion.

With the centrifugal compressor described in the above (15), the inflow direction (incidence angle) to the annular portion can be optimized, and the increase in pressure loss due to the annular portion can be suppressed. Even when the annular portion is in the second position, the flow passage between the outer peripheral surface of the annular portion and the inner wall surface of the bend pipe portion has a relatively uniform shape in the circumferential direction, and no throat is formed. Consequently, it is possible to suppress the increase in pressure loss due to the annular portion when the annular portion is in the second position.

(16) In some embodiments, in the centrifugal compressor described in any one of the above (1) to (15), the inlet pipe portion includes a bend pipe portion configured to bend a flow in the intake passage. The annular portion is configured to be asymmetric with respect to a rotational axis of the impeller so as to bend along an inner wall surface of the bend pipe portion.

With the centrifugal compressor described in the above (16), the inflow direction (incidence angle) to the annular portion can be optimized on both the inner and outer peripheral sides of the bend pipe portion, and the increase in pressure loss due to the annular portion can be suppressed. Further, even when the annular portion is in the second position P2, the flow passage between the outer peripheral surface of the annular portion and the inner wall surface of the bend pipe portion has a relatively uniform shape in the circumferential direction, and no throat is formed. Consequently, it is possible to suppress the increase in pressure loss due to the annular portion when the annular portion is in the second position.

(17) A turbocharger according to at least one embodiment of the present invention comprises a centrifugal compressor described in any one of the above (1) to (16).

With the turbocharger described in the above (17), since the centrifugal compressor described in any one of the above (1) to (16) is included, compared to the configuration in which the strut extends upstream in the axial direction from the annular portion, the length of the strut is reduced. As a result, the configuration of the turbocharger can be simplified, and the increase in pressure loss due to the strut in the intake passage can be suppressed.

Advantageous Effects

At least one embodiment of the present invention provides a centrifugal compressor that can improve the efficiency at the low flow rate operating point with a simply configuration, and a turbocharger including the same.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
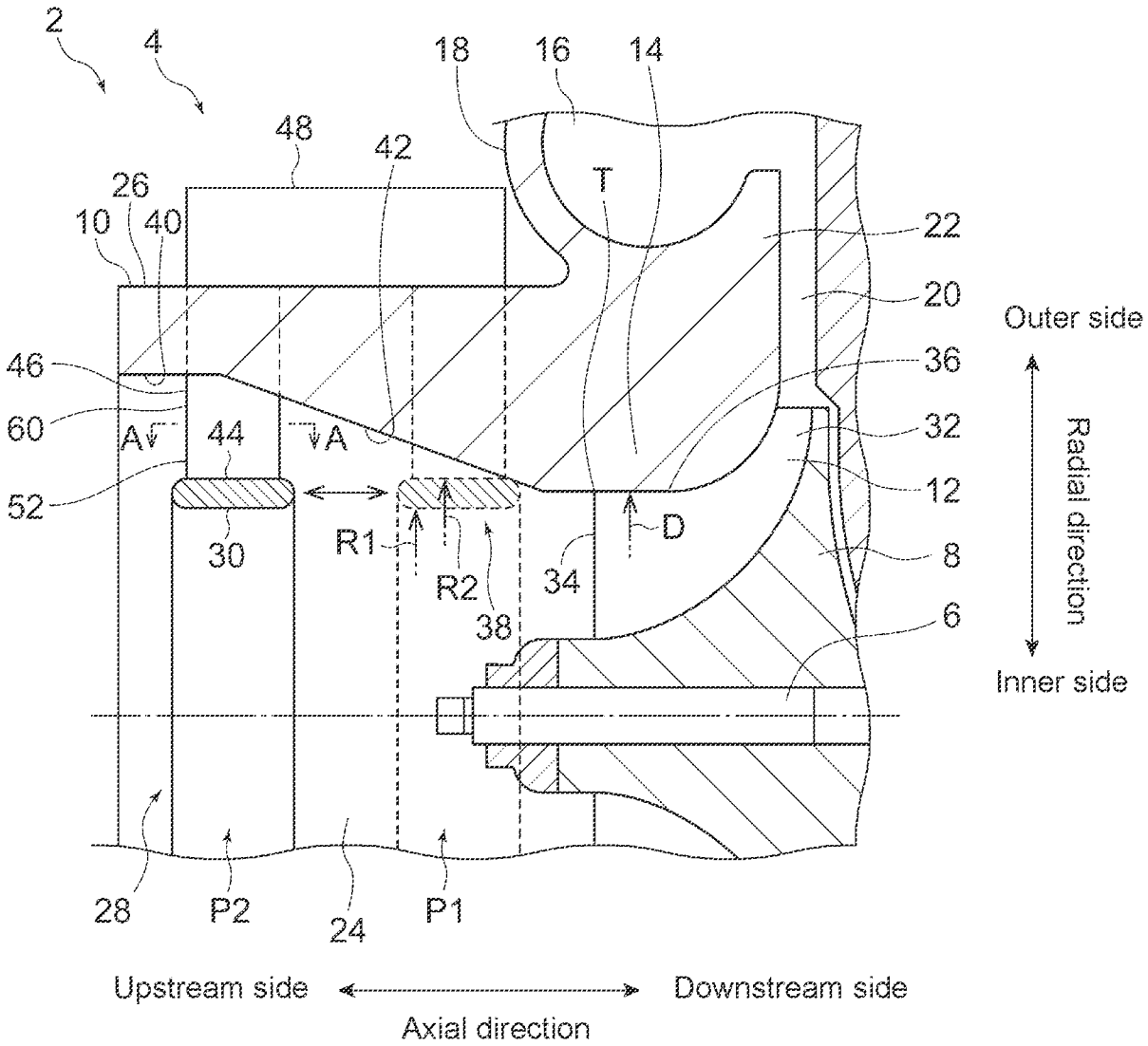
FIG. 1 is a schematic cross-sectional view of a centrifugal compressor 4 of a turbocharger 2 according to an embodiment.

FIG. 1 is a schematic cross-sectional view of a centrifugal compressor 4 of a turbocharger 2 according to an embodiment. The centrifugal compressor 4 is connected to a turbine (not shown) via a rotational shaft 6, and compresses the air taken by an internal combustion engine (not shown) as the rotational power of the turbine driven by exhaust gas of the internal combustion engine (not shown) is transmitted via the rotational shaft 6.

As shown in FIG. 1, the centrifugal compressor 4 includes an impeller 8 and a casing 10 housing the impeller 8. The casing 10 includes a shroud wall portion 14 surrounding the impeller 8 so as to form an impeller housing space 12 in which the impeller 8 is placed, a scroll portion 18 forming a scroll passage 16 on the outer peripheral side of the impeller housing space 12, and a diffuser portion 22 forming a diffuser passage 20 connecting the impeller housing space 12 and the scroll passage 16. Further, the casing 10 includes an inlet pipe portion 26 forming an intake passage 24 to introduce air to the impeller 8 along the rotational axis of the impeller 8. The inlet pipe portion 26 is disposed concentrically with the impeller 8.

Hereinafter, the axial direction of the impeller 8 is referred to as merely "axial direction", and the radial direction of the impeller 8 is referred to as merely "radial direction", and the circumferential direction of the impeller 8 is referred to as merely "circumferential direction".

The centrifugal compressor 4 includes a throttle mechanism 28 (inlet variable mechanism) capable of reducing the flow passage area of the intake passage 24 upstream of the impeller 8 in the axial direction. The throttle mechanism 28 includes an annular portion 30 (movable portion) disposed in the intake passage 24 concentrically with the impeller 8, a strut 46 supporting the annular portion 30, and an actuator 48.

The annular portion 30 is supported by the strut 46. The strut 46 is configured to move the annular portion 30 along the axial direction between a first position P1 and a second position P2 upstream of the first position P1 in the axial direction by a driving force from the actuator 48. The annular portion 30 has a uniform shape in the circumferential direction. The inner diameter R1 of the annular portion 30 is smaller than the diameter D of the impeller 8 at the tip position T of the leading edge 34 of the impeller 8 (position at the radially outer end of the leading edge 34), and the outer diameter R2 of the annular portion 30 is greater than the diameter D of the impeller 8 at the tip position T.

An inner peripheral surface 40 of the inlet pipe portion 26 includes an inclined surface 42 that is inclined such that the inner diameter of the inlet pipe portion 26 increases upstream in the axial direction in order to suppress the increase in pressure loss due to the annular portion 30. In the illustrated exemplary embodiment, the inclined surface 42 is linearly shaped in a cross-section along the rotational axis of the impeller 8.

An outer peripheral surface 44 of the annular portion 30 is disposed so as to face the inclined surface 42. When the annular portion 30 is in the second position P2, the outer peripheral surface 44 of the annular portion 30 is separated from the inclined surface 42. As the annular portion 30 moves downstream in the axial direction from the second position P2, the distance between the outer peripheral surface 44 of the annular portion 30 and the inclined surface 42 decreases. The annular portion 30 is configured to come into contact with the inclined surface 42 when it is in the first position P1 to block an outer peripheral portion 38 of the intake passage 24 corresponding to a tip portion 36 of a blade 32 of the impeller 8 (radially outer end portion of the blade 32). The annular portion 30 faces a leading edge 34 of the tip portion 36 of the blade 32 of the impeller 8 in the axial direction when it is in the first position P1. In other words, in an axial view, the annular portion 30 and the tip portion 36 at least partially overlap.

The strut 46 shown in FIG. 1 includes an outer extension portion 52 extending outward in the radial direction with an increase in distance from the annular portion 30. In the illustrated exemplary embodiment, the outer extension portion 52 extends linearly along the radial direction from the outer peripheral surface 44 of the annular portion 30 to the actuator 48.

With the above configuration, the annular portion 30 reduces the flow passage area of the intake passage 24 by blocking the outer peripheral portion 38 of the intake passage 24 corresponding to the tip portion 36 of the blade 32 of the impeller 8. As a result, although the peak efficiency is reduced due to the reduced flow passage area, it is possible to reduce the surge flow rate and improve the efficiency near the surge point. In other words, by adjusting the throttle mechanism 28 so that the annular portion 30 is in the first position P1 at the low flow rate operating point (operating point near the surge point) and the annular portion 30 is in the second position P2 at the high flow rate operating point (for example, during rated operation) where the flow rate is higher than the low flow rate operating point, the efficiency of the low flow rate operating point can be improved, and the operating range of the centrifugal compressor 4 can be expanded.

Figure 2:
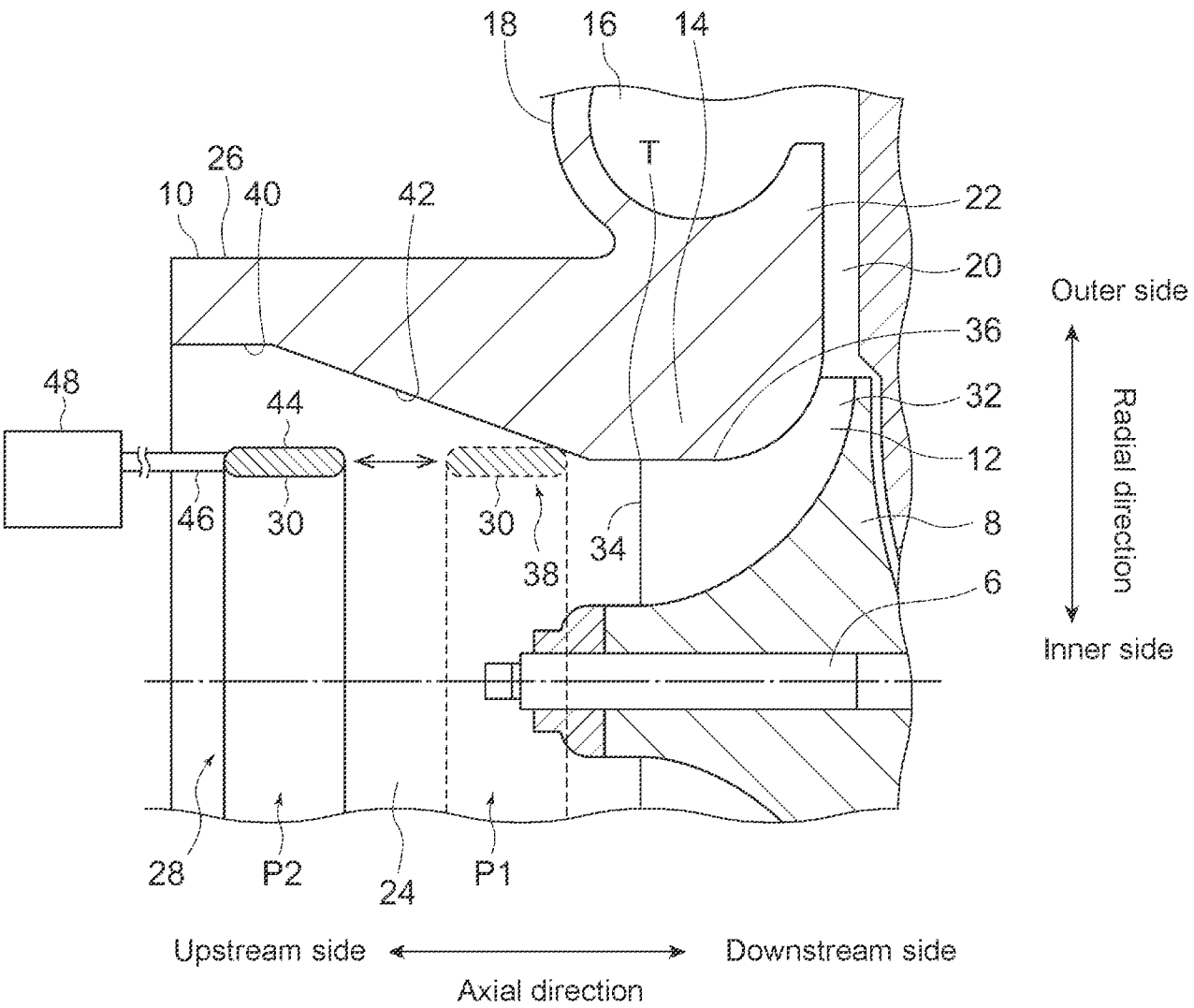
FIG. 2 is a schematic cross-sectional view of a centrifugal compressor according to a comparative embodiment.

Further, since the strut 46 is composed of the outer extension portion 52 extending outward in the radial direction with an increase in distance from the annular portion 30, compared to the configuration according to the comparative embodiment shown FIG. 2 (configuration in which the strut 46 extends upstream in the axial direction from the annular portion 30), the length of the strut 46 is reduced, so that the configuration can be simplified, and the increase in pressure loss due to the strut 46 in the intake passage 24 can be suppressed.

Next, other embodiments of the centrifugal compressor 4 will be described with reference to FIGS. 3 to 6. In the other embodiments of the centrifugal compressor 4 described below, reference signs common to the components of the centrifugal compressor 4 shown in FIG. 1 indicate the same components of the centrifugal compressor shown in FIG. 1 unless otherwise noted, and the explanation is omitted.

In some embodiments, for example as shown in FIGS. 3 to 6, an outer peripheral surface 49 of the inlet pipe portion 26 includes an inclined surface 50 that is inclined such that the outer diameter of the inlet pipe portion 26 increases upstream in the axial direction.

With the above configuration, a space between the inclined surface 50 and the diffuser portion 22 or a space between the inclined surface 50 and the scroll portion 18 can be effectively used as the space for installing the actuator 48. Consequently, it is possible to prevent the enlargement of the centrifugal compressor 4 due to the installation of the throttle mechanism 28. From the viewpoint of downsizing the centrifugal compressor 4, the actuator 48 is desirably installed downstream of a downstream end 51 of the inclined surface 50 in the axial direction, as shown in FIGS. 3 to 6.

Figure 3:
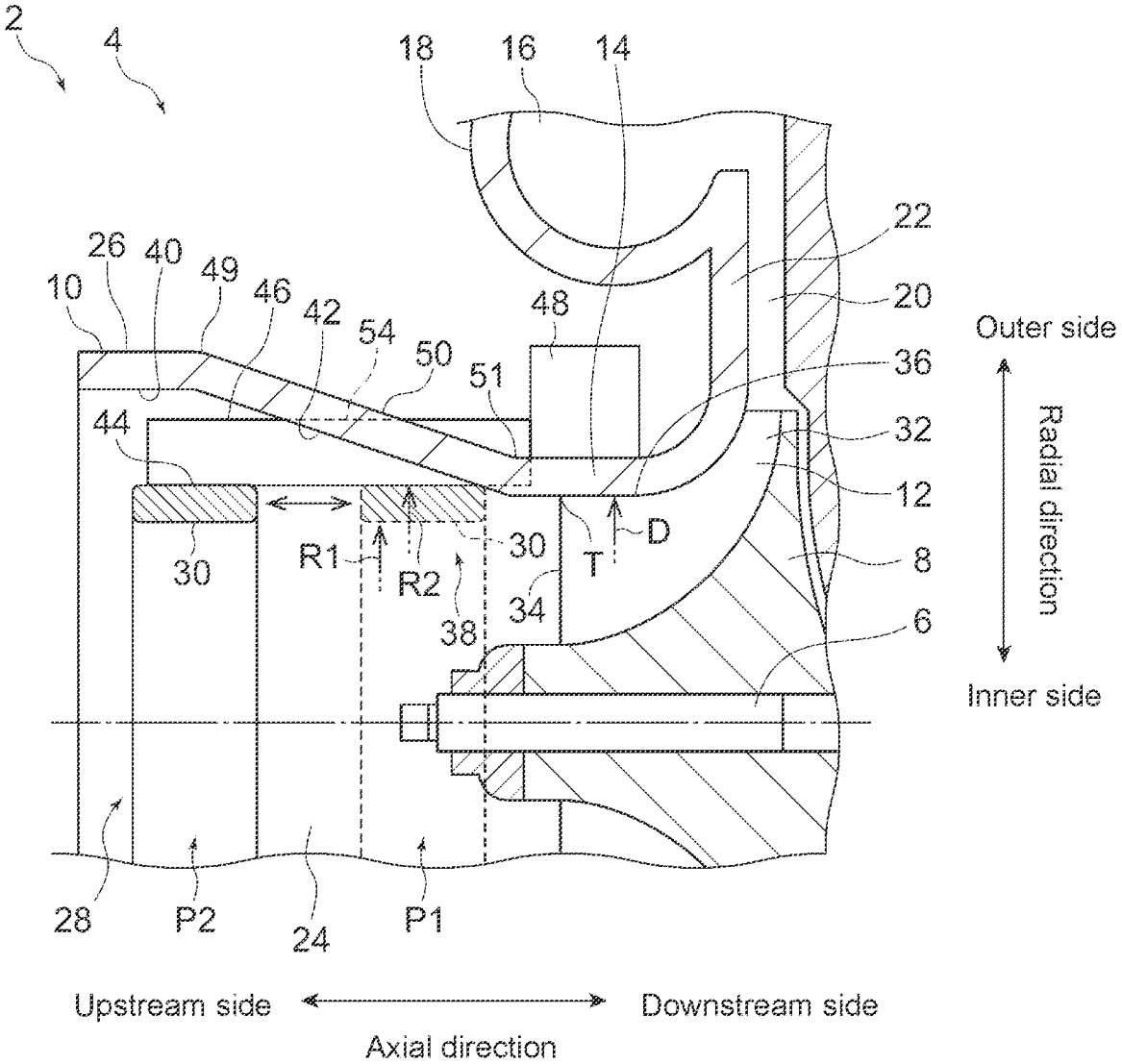
FIG. 3 is a schematic cross-sectional view of the centrifugal compressor 4 according to another embodiment.

In some embodiments, for example as shown in FIG. 3, the strut 46 includes a downstream extension portion 54 extending downstream in the axial direction with an increase in distance from the annular portion 30. In the exemplary embodiment shown in FIG. 3, the strut 46 extends linearly along the axial direction from the outer peripheral surface 44 of the annular portion 30 to the actuator 48 located between the inclined surface 50 and the diffuser portion 22.

Figure 4:
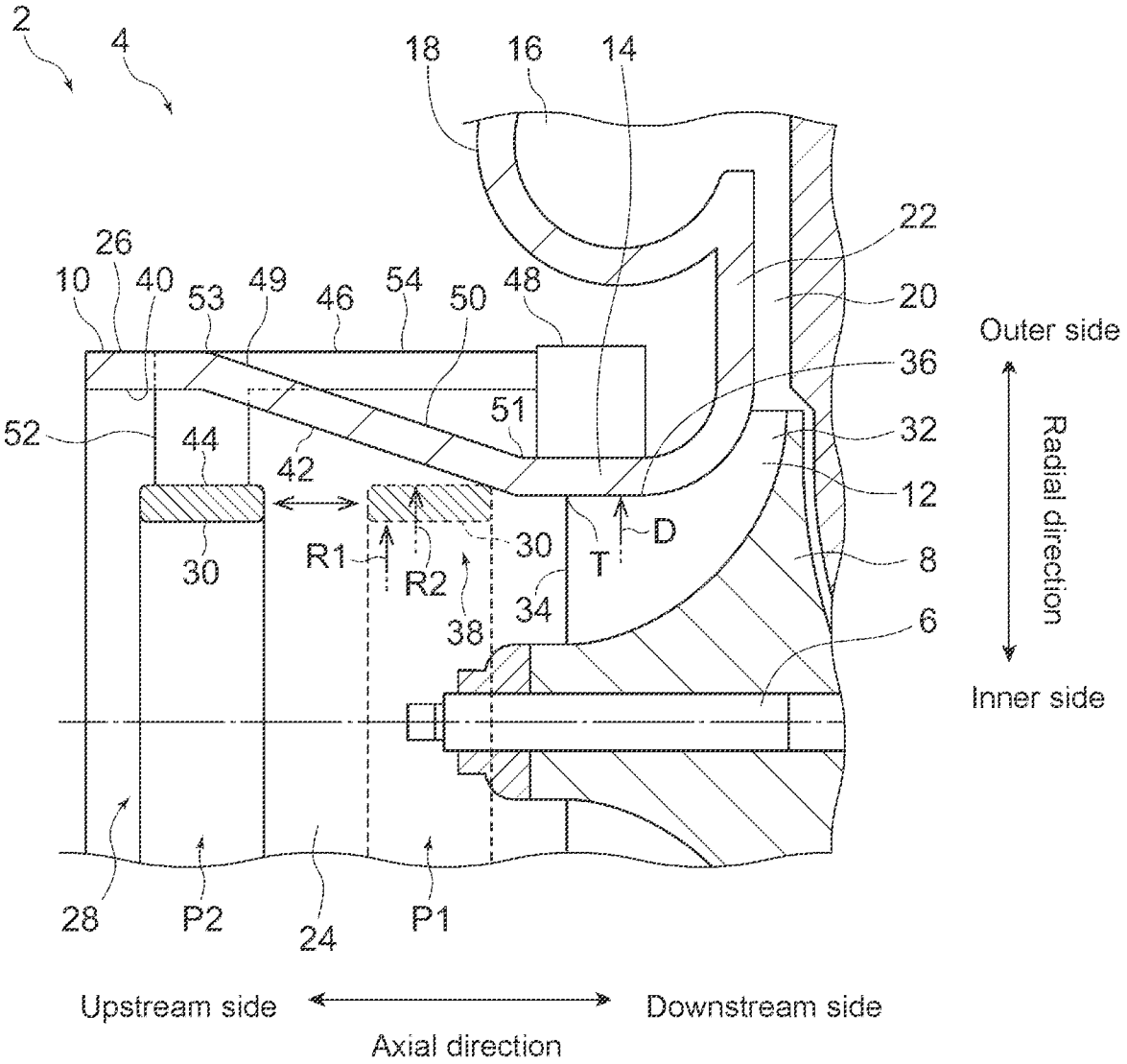
FIG. 4 is a schematic cross-sectional view of the centrifugal compressor 4 according to another embodiment.
Figure 5:
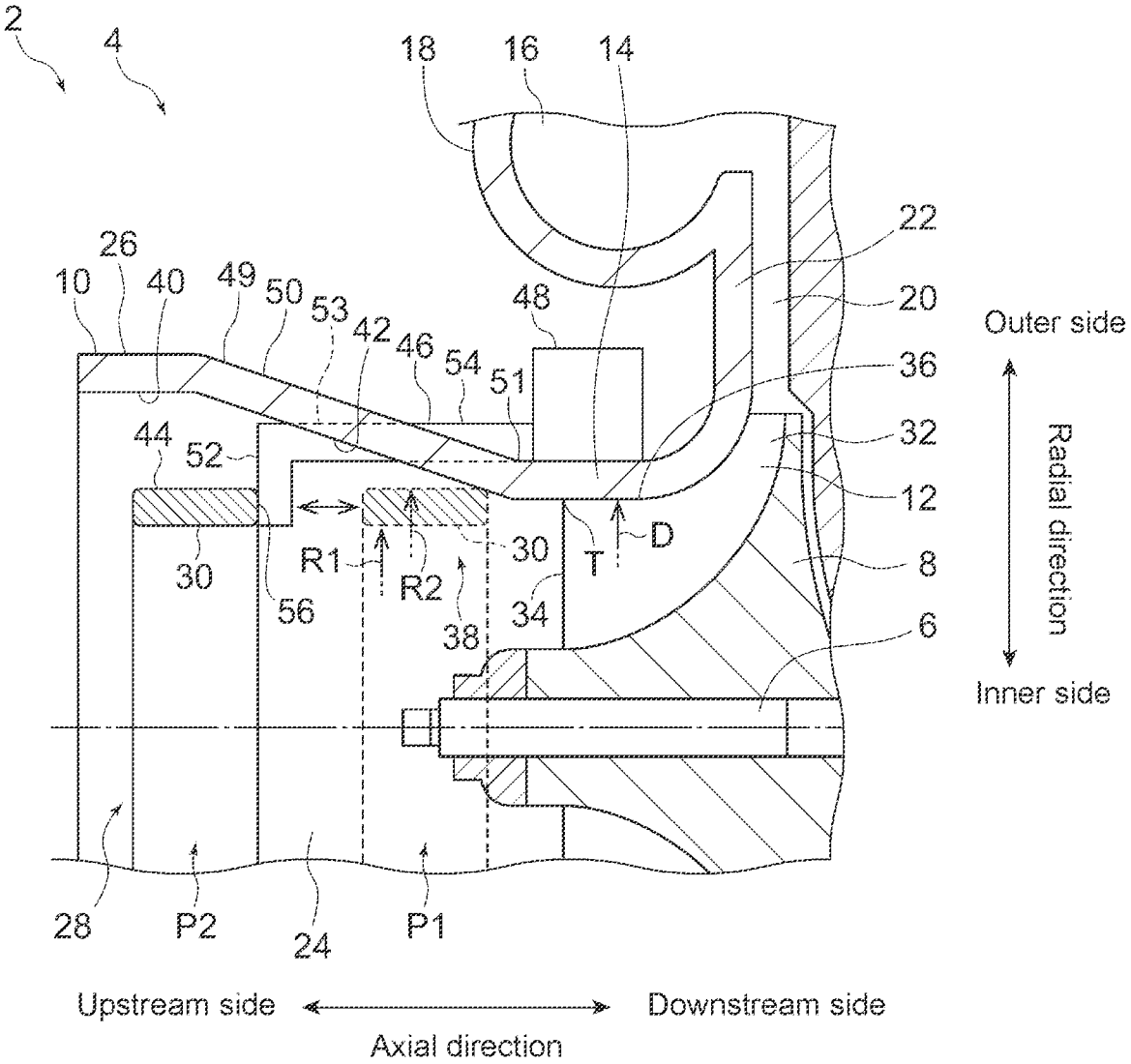
FIG. 5 is a schematic cross-sectional view of the centrifugal compressor 4 according to another embodiment.

In some embodiments, for example as shown in FIGS. 4 and 5, the strut 46 includes an outer extension portion 52 extending outward in the radial direction with an increase in distance from the annular portion 30 and a downstream extension portion 54 extending downstream in the axial direction with an increase in distance from the annular portion 30. In the exemplary embodiment shown in FIG. 4, the outer extension portion 52 extends linearly along the radial direction from the outer peripheral surface 44 of the annular portion 30, and the downstream extension portion 54 extends linearly along the axial direction from a radially outer end 53 of the outer extension portion 52 to the actuator 48 located between the inclined surface 50 and the diffuser portion 22. In the exemplary embodiment shown in FIG. 5, the outer extension portion 52 extends linearly along the radial direction from an end surface 56 of the annular portion 30, and the downstream extension portion 54 extends linearly along the axial direction from a radially outer end 53 of the outer extension portion 52 to the actuator 48.

Figure 6:
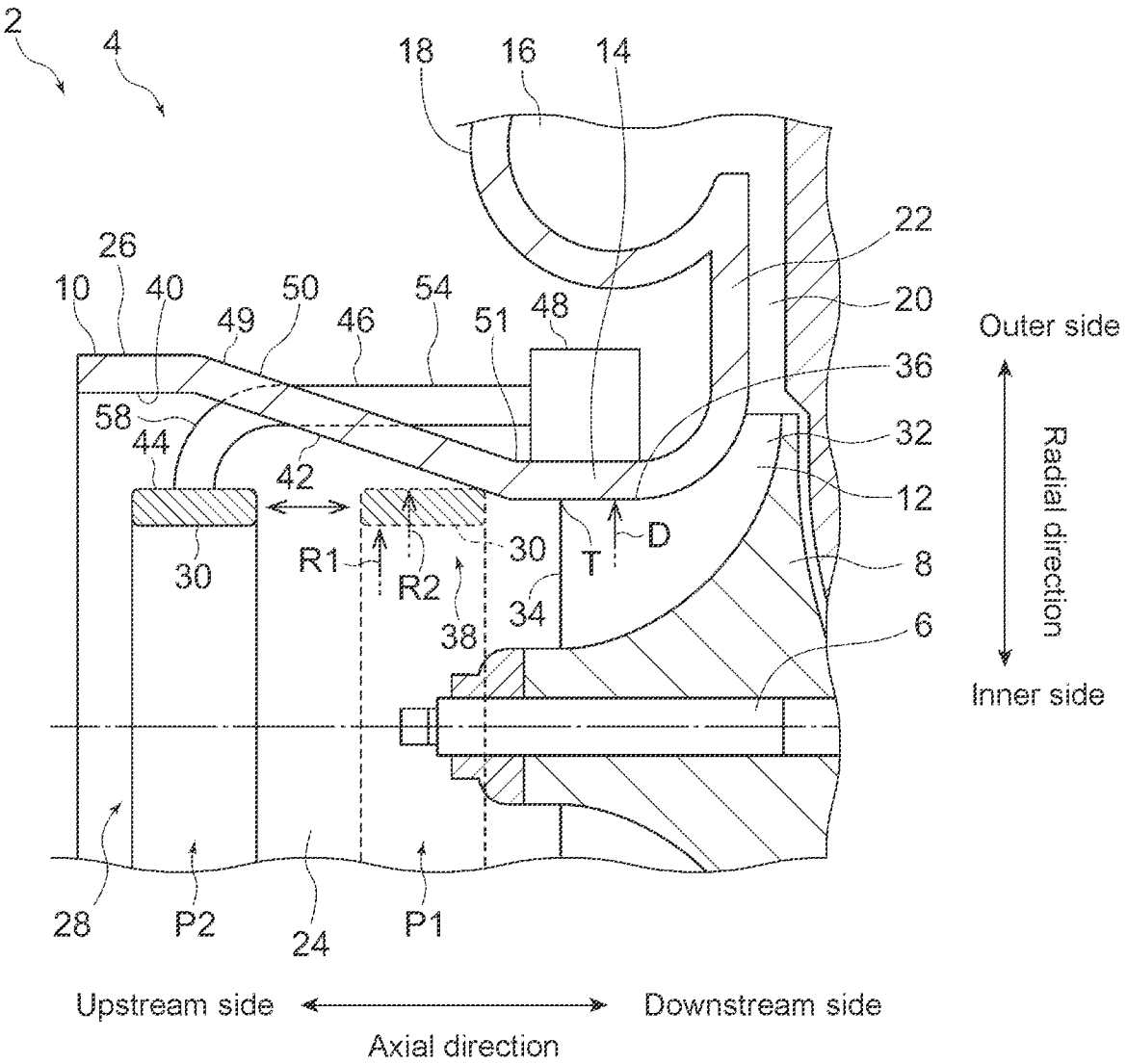
FIG. 6 is a schematic cross-sectional view of the centrifugal compressor 4 according to another embodiment.

In some embodiments, for example as shown in FIG. 6, the strut 46 includes a curved portion 58 curved and extending outward in the radial direction and downstream in the axial direction with an increase in distance from the annular portion 30 and a downstream extension portion 54 extending downstream in the axial direction with an increase in distance from the annular portion 30. In the exemplary embodiment shown in FIG. 6, the curved portion 58 extends outward in the radial direction and downstream in the axial direction from the outer peripheral surface 44 of the annular portion 30, and the downstream extension portion 54 extends linearly along the axial direction from a downstream end 59 of the curved portion 58 to the actuator 48 located between the inclined surface 50 and the diffuser portion 22. In other embodiments, the strut 46 may be composed of only the curved portion extending from the annular portion 30 to the actuator 48, or may be composed of a combination of the outer extension portion, the curved portion, and the downstream extension portion 54.

FIGS. 7A to 7E each show a configuration example of cross-section A-A (cross-section perpendicular to the radial direction) in FIG. 1. The cross-section A-A in FIG. 1 is a cross-section of a passage extension portion 60 of the outer extension portion 52 facing the intake passage, taken perpendicular to the radial direction. The cross-sectional shapes of FIGS. 7A to 7E can be applied to the strut 46 of not only the embodiment shown in FIG. 1, but also any other of the above-described embodiments.

In some embodiments, for example as shown in FIGS. 7A to 7E, in a cross-section perpendicular to the radial direction, a>b is satisfied, where a is a distance between a leading edge 66 of the passage extension portion 60 and a trailing edge 68 of the passage extension portion 60, and b is a thickness of the passage extension portion 60 in a direction perpendicular to a straight line connecting the leading edge 66 and the trailing edge 68 (maximum thickness of the passage extension portion 60). With this configuration, the increase in pressure loss due to the passage extension portion 60 can be suppressed. The leading edge 66 of the passage extension portion 60 means the upstream end of the passage extension portion 60 in the axial direction, and the trailing edge 68 of the passage extension portion 60 means the downstream end of the passage extension portion 60 in the axial direction.

In some embodiments, for example as shown in FIGS. 7A to 7E, the thickness of a leading edge portion 62 of the passage extension portion 60 (thickness in a direction perpendicular to the straight line connecting the leading edge 66 and the trailing edge 68) decreases upstream in the axial direction. With this configuration, the increase in pressure loss due to the flow impinging on the leading edge portion 62 of the passage extension portion 60 can be suppressed. The leading edge portion 62 of the passage extension portion 60 means the upstream end portion of the passage extension portion 60 in the axial direction.

In some embodiments, for example as shown in FIGS. 7A to 7E, the thickness t of a trailing edge portion 64 of the passage extension portion 60 decreases downstream in the axial direction. With this configuration, the increase in pressure loss caused on the back side of the trailing edge portion 64 of the passage extension portion 60 can be suppressed. The trailing edge portion 64 of the passage extension portion 60 means the downstream end portion of the passage extension portion 60 in the axial direction.

Figure 7A:
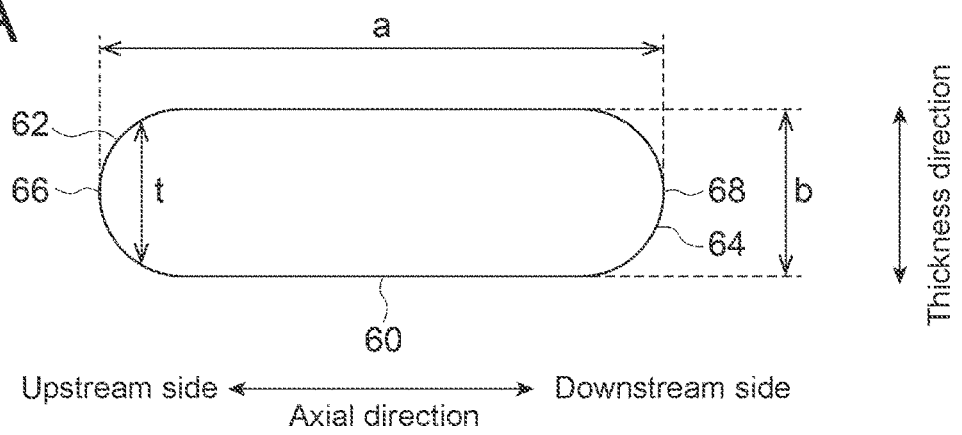
FIG. 7A is a diagram showing an example of the shape of cross-section A-A (cross-section perpendicular to the radial direction) in FIG. 1.
Figure 7B:
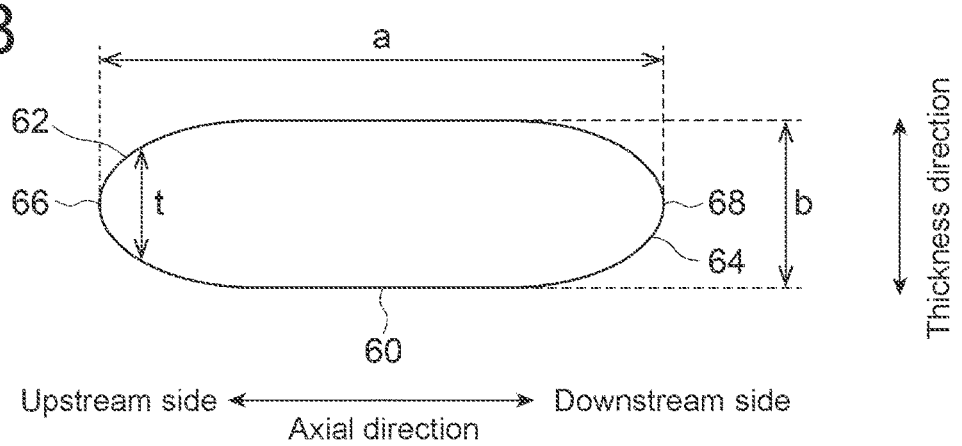
FIG. 7B is a diagram showing another example of the shape of cross-section A-A in FIG. 1.

In some embodiments, for example as shown in FIGS. 7A and 7B, the leading edge portion 62 of the passage extension portion 60 and the trailing edge portion 64 of the passage extension portion 60 may have a blunt shape. Each of the leading edge portion 62 and the trailing edge portion 64 of the passage extension portion 60 shown in FIG. 7A is formed by an arc having a certain radius of curvature in a cross-section perpendicular to the radial direction, and the leading edge portion 62 and the trailing edge portion 64 are connected by a pair of straight lines. Each of the leading edge portion 62 and the trailing edge portion 64 of the passage extension portion 60 shown in FIG. 7B is formed by a part of ellipse in a cross-section perpendicular to the radial direction, and the leading edge portion 62 and the trailing edge portion 64 are connected by a pair of straight lines. The ellipse that defines a part of the shape shown in FIG. 7B may have a ratio of minor to major axis of about 1:2 from the viewpoint of reducing the pressure loss.

Figure 7C:
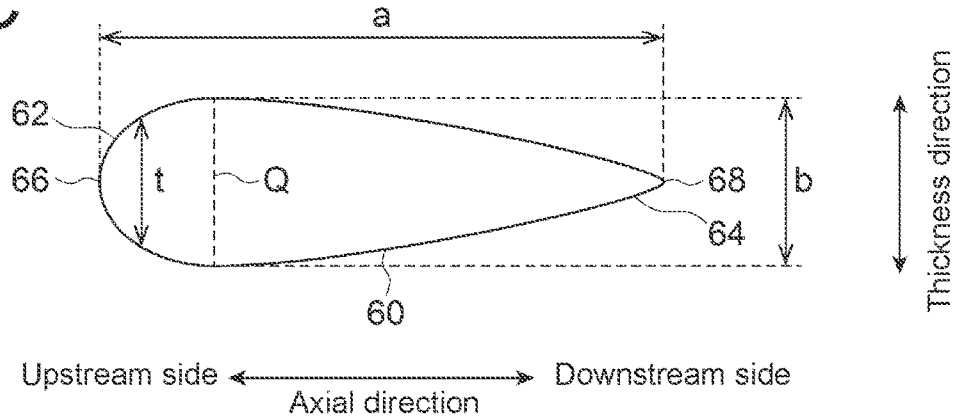
FIG. 7C is a diagram showing another example of the shape of cross-section A-A in FIG. 1.

In some embodiments, for example as shown in FIG. 7C, the passage extension portion 60 has an airfoil shape in a cross-section perpendicular to the radial direction. In the embodiment shown in FIG. 7C, the leading edge portion 62 of the passage extension portion 60 has a blunt shape, and the trailing edge portion 64 of the passage extension portion 60 has a sharp shape. Further, the maximum blade thickness position Q in the airfoil shape of the passage extension portion 60 is located between the leading edge 66 and the 50% chordwise position.

Figure 7D:
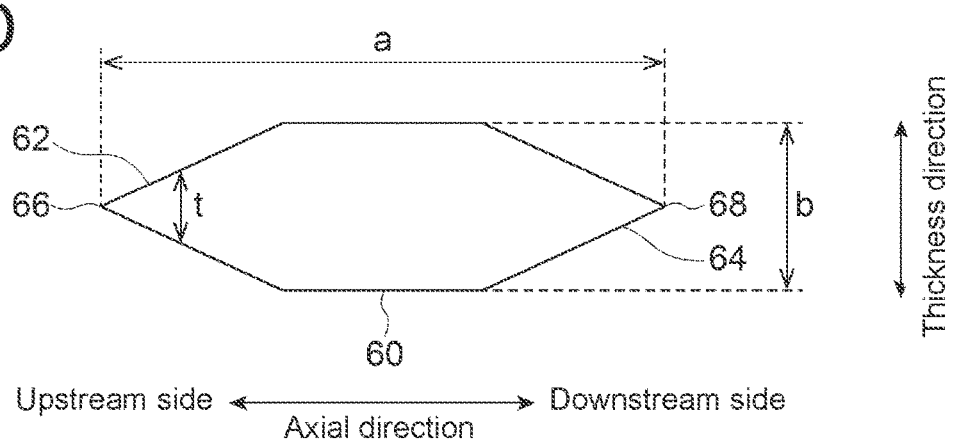
FIG. 7D is a diagram showing another example of the shape of cross-section A-A in FIG. 1.
Figure 7E:
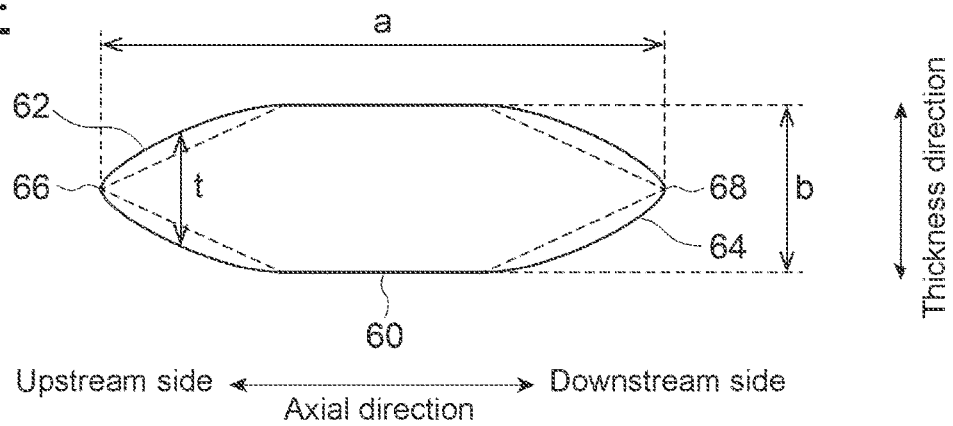
FIG. 7E is a diagram showing another example of the shape of cross-section A-A in FIG. 1.

In some embodiments, for example as shown in FIGS. 7D and 7E, the leading edge portion 62 of the passage extension portion 60 and the trailing edge portion 64 of the passage extension portion 60 may have a sharp shape. In this case, in a cross-section perpendicular to the radial direction, each of the leading edge portion 62 and the trailing edge portion 64 of the passage extension portion 60 may include a pair of straight lines connected at one end in the axial direction as shown in FIG. 7D or may include a pair of curves connected at one end in the axial direction as shown in FIG. 7E.

In some embodiments, for example as shown in FIGS. 8 to 11, in a cross-section perpendicular to the radial direction, a straight line C connecting the leading edge 66 and the trailing edge 68 of the passage extension portion 60 is inclined downstream in the rotation direction as it goes downstream in the axial direction.

Figure 8:
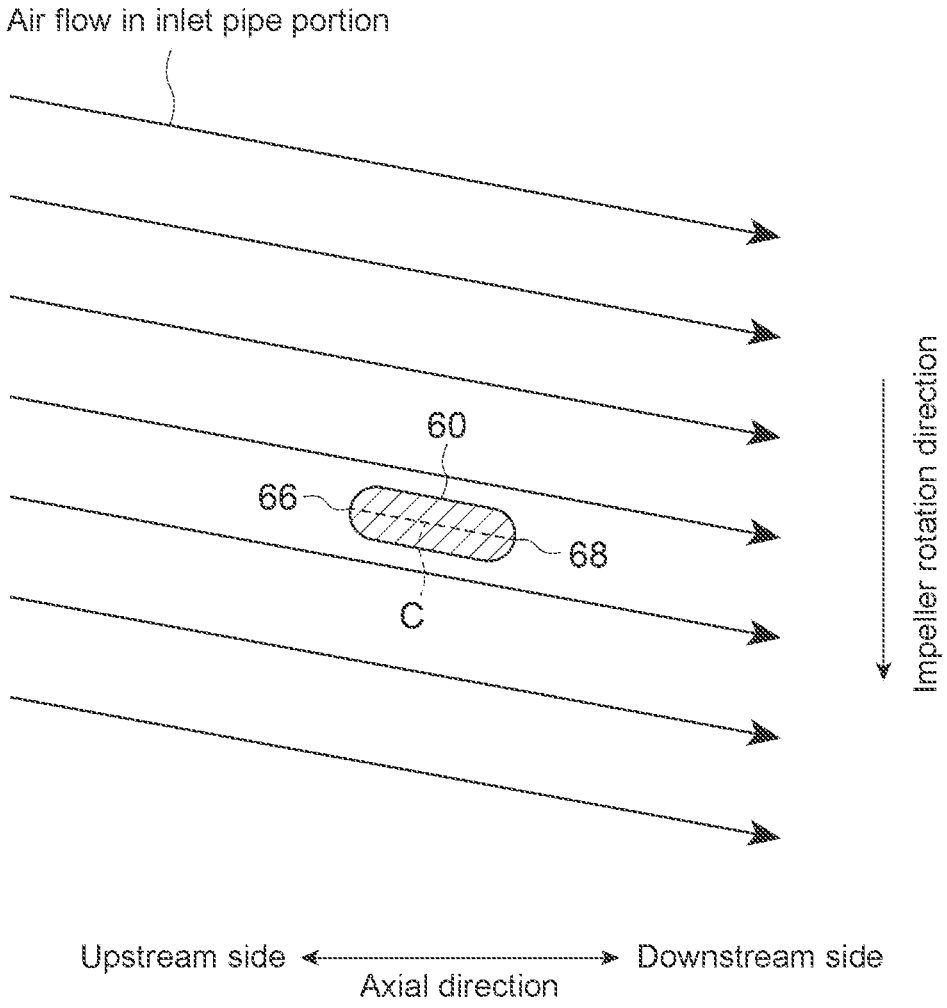
FIG. 8 is a diagram showing an example of a relationship between the flow direction in the inlet pipe portion 26 and the arrangement of the passage extension portion 60.
Figure 11:
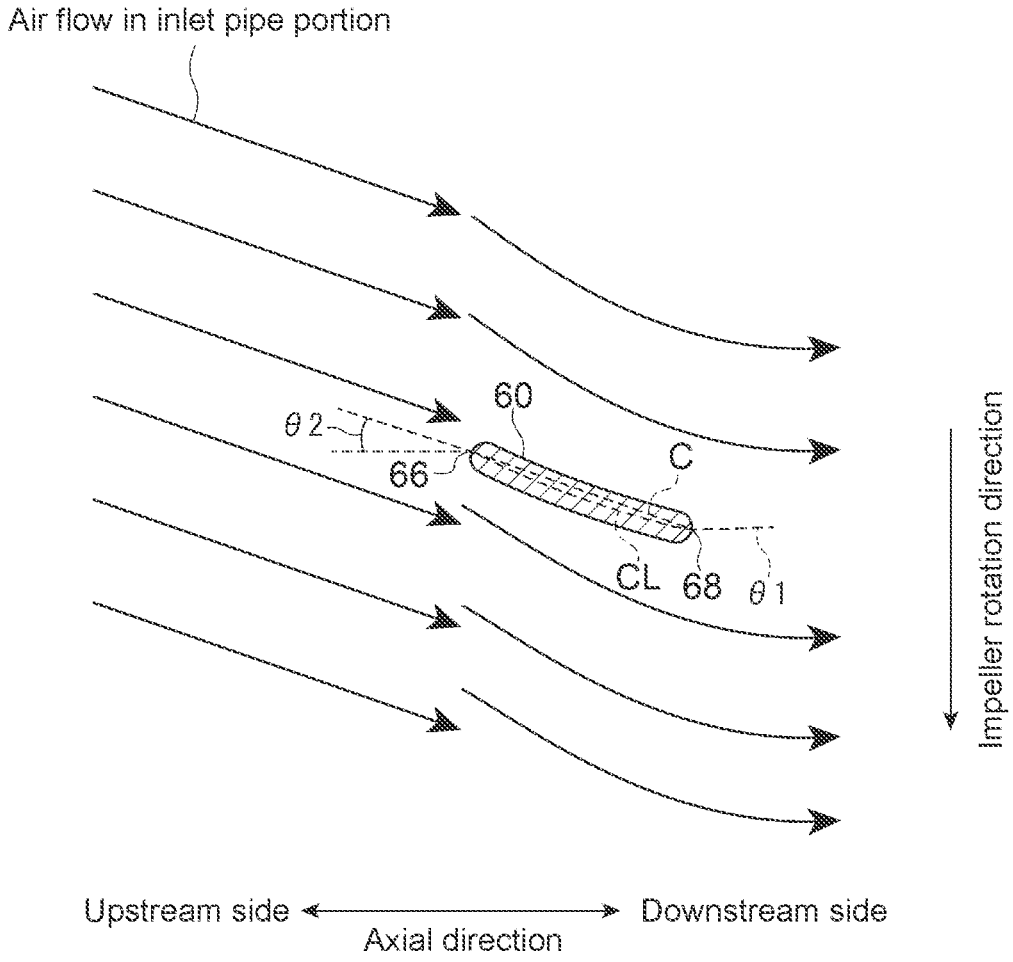
FIG. 11 is a diagram showing an example of a relationship between the flow direction in the inlet pipe portion 26 and the arrangement of the passage extension portion 60.

As shown in FIGS. 8 and 11, the flow may flow into the inlet pipe portion 26 of the centrifugal compressor 4 with pre-swirl. In this case, the passage extension portion 60 designed such that the straight line C is parallel to the axial direction leads to the increase in pressure loss, and it is thus desirable to incline the straight line C as described above along the direction of flow with pre-swirl.

Figure 9:
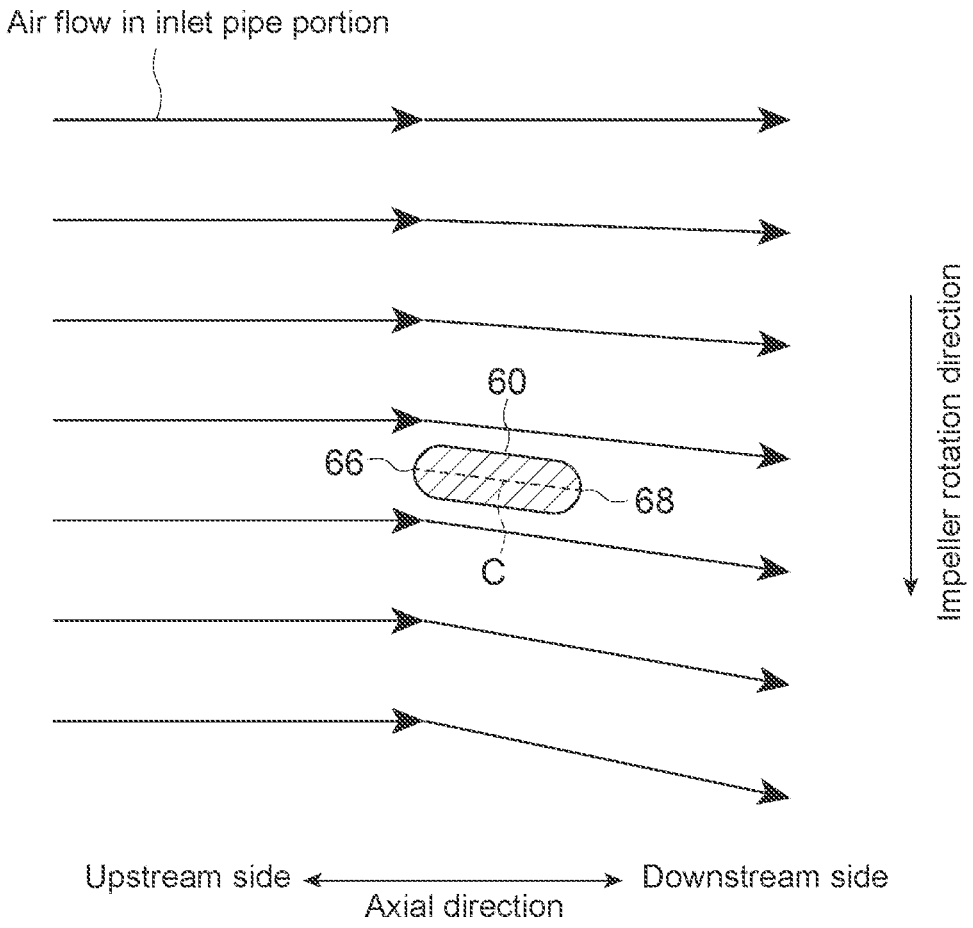
FIG. 9 is a diagram showing an example of a relationship between the flow direction in the inlet pipe portion 26 and the arrangement of the passage extension portion 60.
Figure 10:
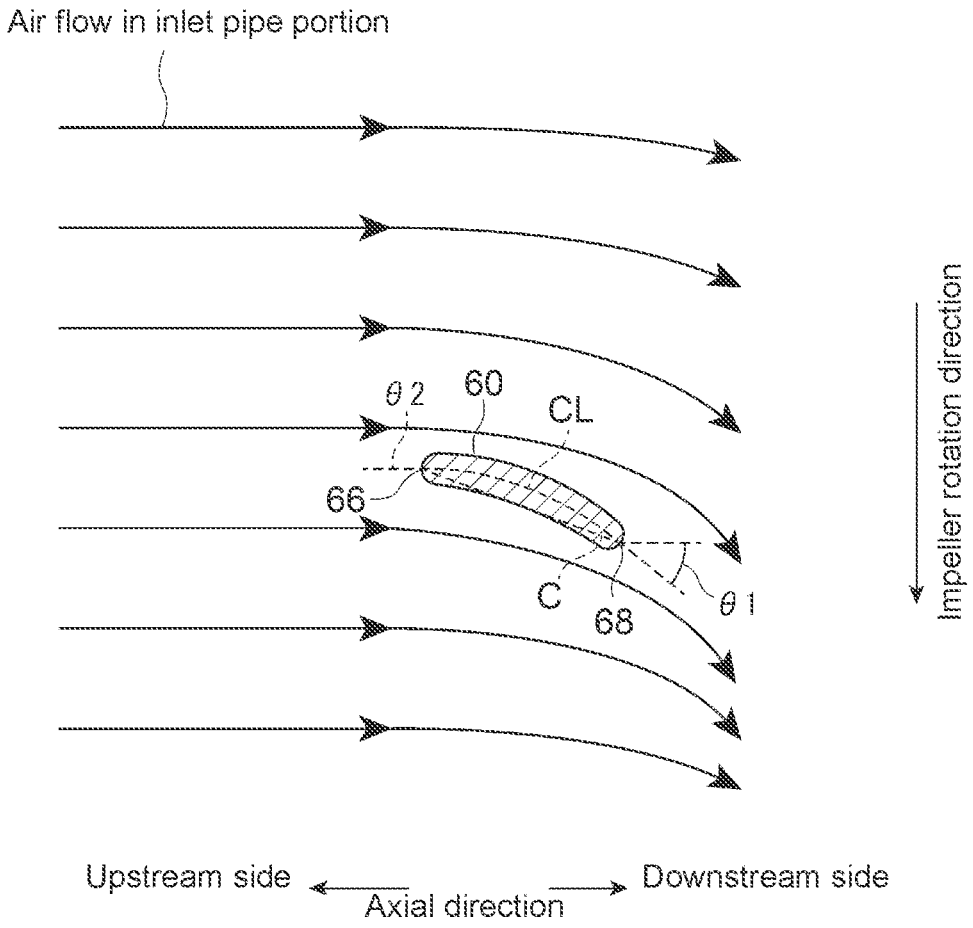
FIG. 10 is a diagram showing an example of a relationship between the flow direction in the inlet pipe portion 26 and the arrangement of the passage extension portion 60.

Further, even if the flow flows in the axial direction to the inlet pipe portion 26 of the centrifugal compressor 4 as shown in FIGS. 9 and 10, it may be better to impart pre-swirl to the flow to improve the performance of the impeller 8. In this case, if the straight line C connecting the leading edge 66 and the trailing edge 68 of the passage extension portion 60 is inclined as described above, the passage extension portion 60 functions as an inlet guide vane, and the flow is deflected by the passage extension portion 60 to have pre-swirl. As a result, it is possible to improve the performance of the impeller 8.

In some embodiments, for example as shown in FIG. 10, in order to optimize the flow direction (incidence) relative to the passage extension portion 60 and effectively impart pre-swirl to the flow in the inlet pipe portion 26, the passage extension portion 60 may have a curved cross-sectional shape. In the embodiment shown in FIG. 10, in a cross-section perpendicular to the radial direction, when CL is a center line (camber line) connecting the leading edge 66 and the trailing edge 68 of the passage extension portion 60 and passing through the center position in the thickness direction (direction perpendicular to the straight line C) of the passage extension portion 60, an angle θ1 between the center line CL and the axial direction at the position of the trailing edge 68 is greater than an angle θ2 between the center line CL and the axial direction at the position of the leading edge 66 (in the illustrated embodiment, θ2=0°). Further, the center line CL is curved so as to smoothly deflect the flow.

In some embodiments, for example as shown in FIG. 11, in order to reduce undesirable pre-swirl in the inlet pipe portion 26, the passage extension portion 60 may have a curved cross-sectional shape. In the embodiment shown in FIG. 11, in a cross-section perpendicular to the radial direction, the angle θ1 between the center line CL and the axial direction at the position of the trailing edge 68 (in the illustrated embodiment, θ1=0°) is smaller than an angle θ2 between the center line CL and the axial direction at the position of the leading edge 66. Further, the center line CL is curved so as to smoothly deflect the flow.

Figure 12:
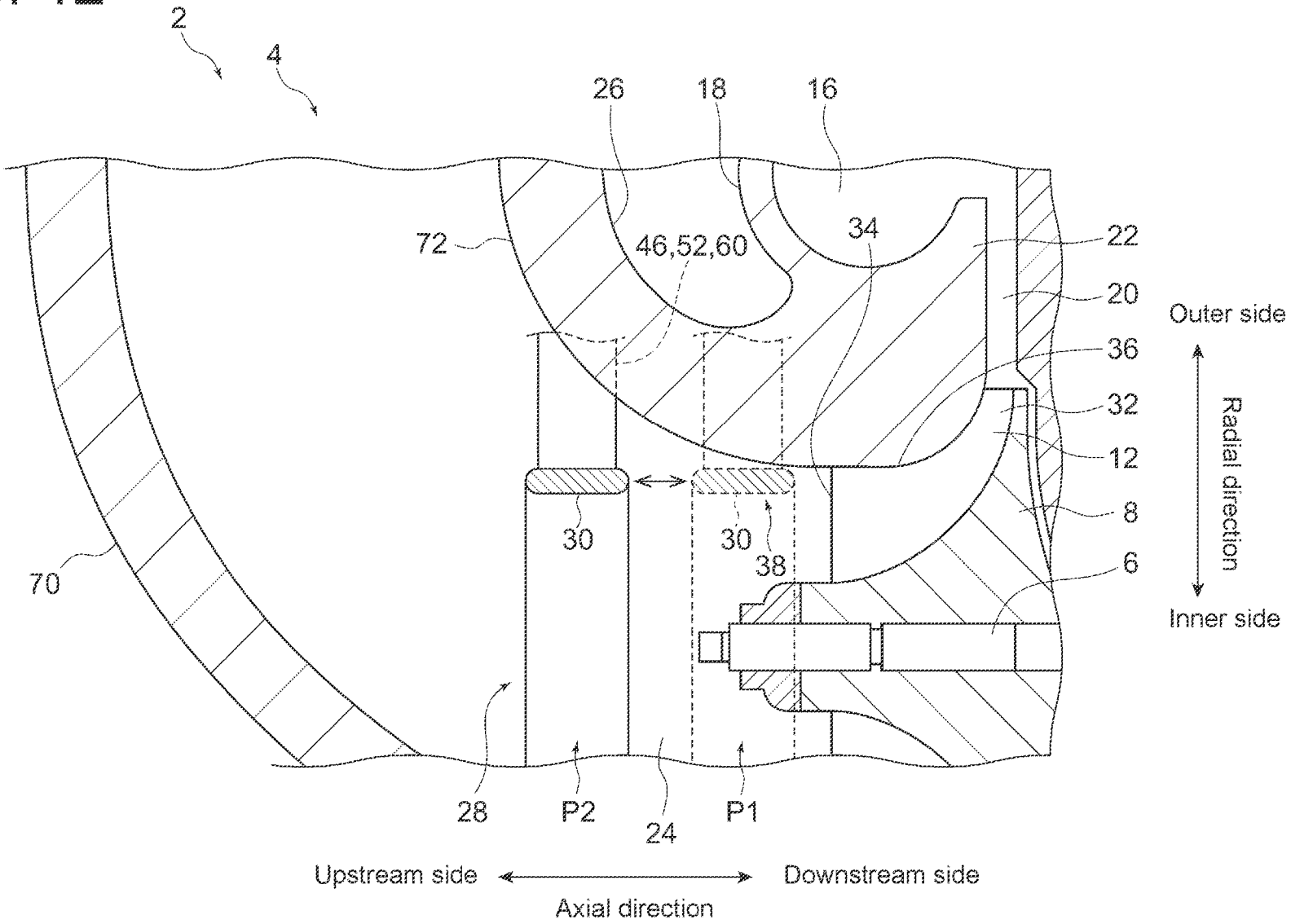
FIG. 12 is a schematic cross-sectional view of the centrifugal compressor 4 according to another embodiment.
Figure 13:
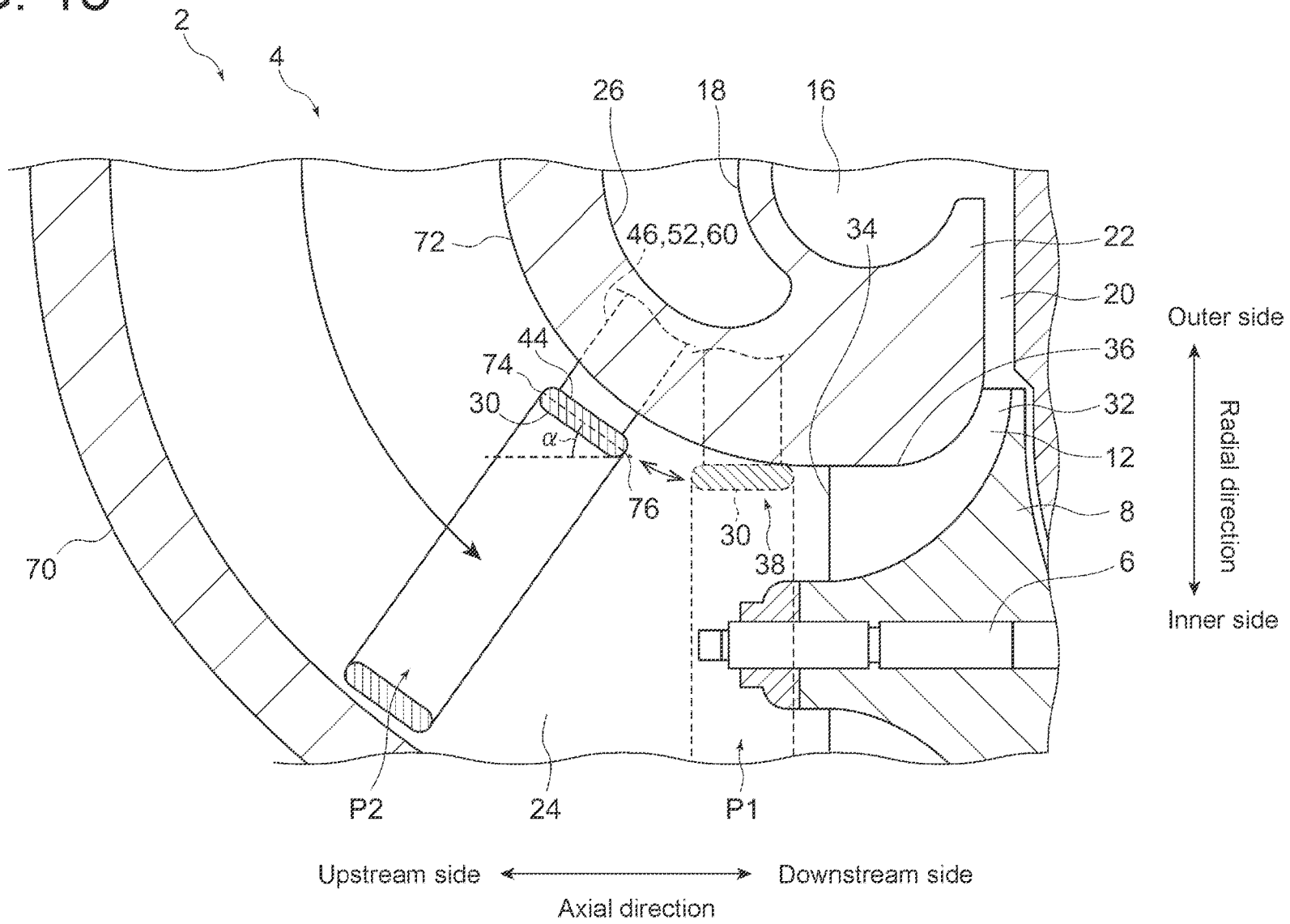
FIG. 13 is a schematic cross-sectional view of the centrifugal compressor 4 according to another embodiment.
Figure 14:
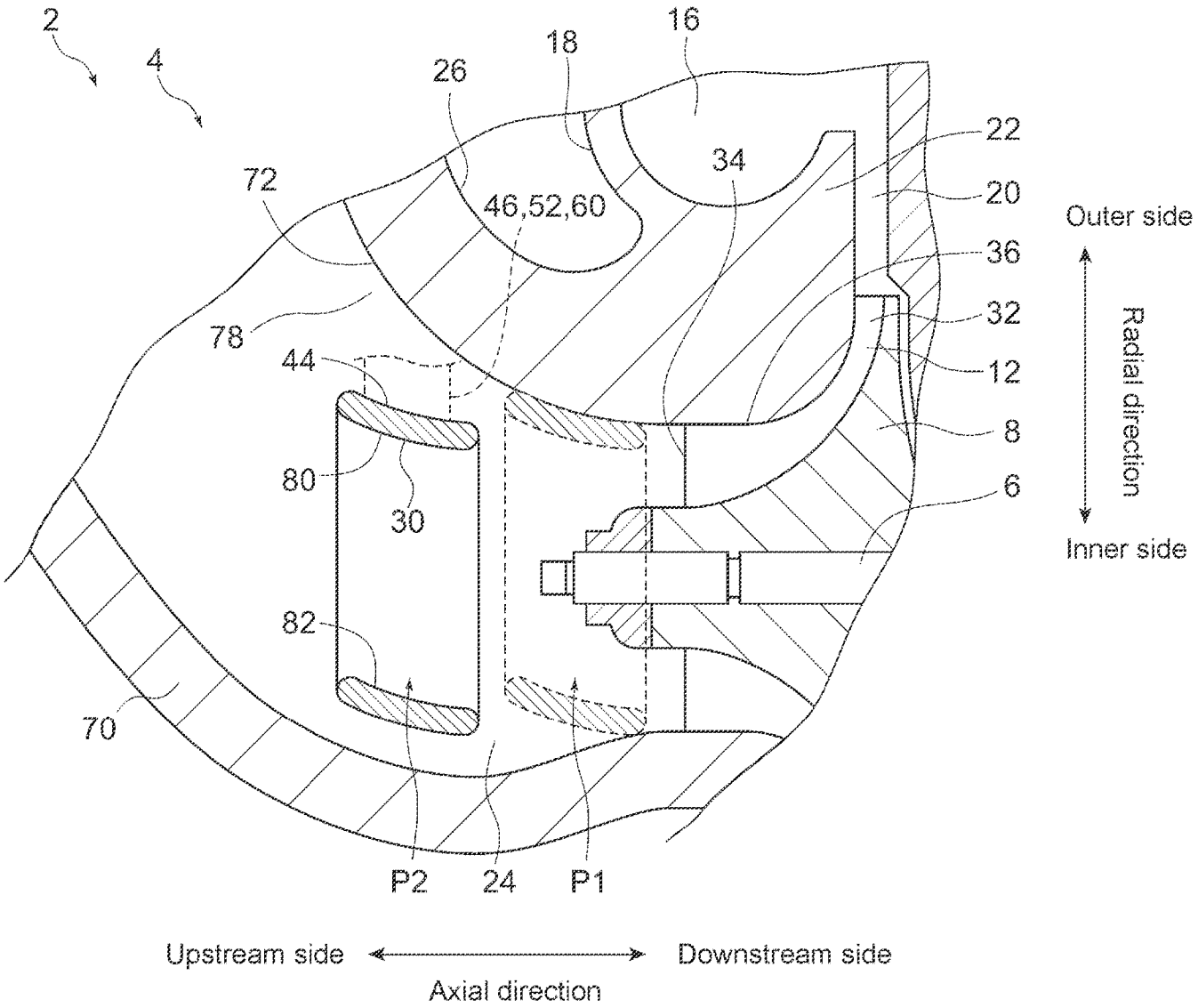
FIG. 14 is a schematic cross-sectional view of the centrifugal compressor 4 according to another embodiment.

In some embodiments, for example as shown in FIGS. 12 to 14, the inlet pipe portion 26 may include a bend pipe portion 70 configured to bend the flow in the intake passage 24. In this case, the annular portion 30 may move between the first position P1 and the second position P2 along the axial direction, for example as shown in FIGS. 12 and 14, or may move along the inclination direction of an inner wall surface 72 of the bend pipe portion 70 between the first position P1 and the second position P2, as shown in FIG. 13.

In the exemplary embodiment shown in FIG. 13, in a cross-section along the rotational axis of the impeller 8, the annular portion 30 moves in an arc-shaped path along the inclination direction of the inner wall surface 72 of the bend pipe portion 70. Therefore, the angle α between the axial direction and the straight line connecting a leading edge 74 of the annular portion 30 and a trailing edge 76 of the annular portion 30 at the second position P2 can be made larger than the angle α between the axial direction and the straight line connecting the leading edge 74 and the trailing edge 76 at the first position P1. With this configuration, the inflow direction (incidence angle) to the annular portion 30 can be optimized, and the increase in pressure loss due to the annular portion can be suppressed.

In the configuration shown in FIG. 12, when the annular portion 30 is in the second position P2, a flow passage portion 78 between the outer peripheral surface 44 of the annular portion 30 and the inner wall surface 72 of the bend pipe portion 70 has a non-uniform shape in the circumferential direction, and a throat is formed at a certain circumferential position, so that pressure loss occurs due to the increase in flow velocity at the throat position. In contrast, in the configuration shown in FIG. 13, since the annular portion 30 moves along the inclination direction of the inner wall surface 72 of the bend pipe portion 70 as described above, even when the annular portion 30 is in the second position P2, the flow passage portion 78 between the outer peripheral surface 44 of the annular portion 30 and the inner wall surface 72 of the bend pipe portion 70 has a relatively uniform shape in the circumferential direction, and no throat is formed. Consequently, it is possible to suppress the increase in pressure loss due to the annular portion 30 when the annular portion 30 is in the second position P2.

In the configuration shown in FIG. 14, the annular portion 30 is asymmetric with respect to the rotational axis of the impeller 8 so as to bend along the inner wall surface 72 of the bend pipe portion 70. Further, a portion 80 of the annular portion 30 on the inner diameter side of the bend pipe portion 70 and the portion 82 of the annular portion 30 on the outer diameter side of the bend pipe portion 70 extend parallel to each other. When the annular portion 30 is curved along the inner wall surface 72 of the bend pipe portion 70 as described above, the inflow direction (incidence angle) to the annular portion 30 can be optimized on both the inner and outer diameter sides of the bend pipe portion 70, and the increase in pressure loss due to the annular portion 30 can be suppressed. Further, even when the annular portion 30 is in the second position P2, the flow passage portion 78 between the outer peripheral surface 44 of the annular portion 30 and the inner wall surface 72 of the bend pipe portion 70 has a relatively uniform shape in the circumferential direction, and no throat is formed. Consequently, it is possible to suppress the increase in pressure loss due to the annular portion 30 when the annular portion 30 is in the second position P2.

Figure 15:
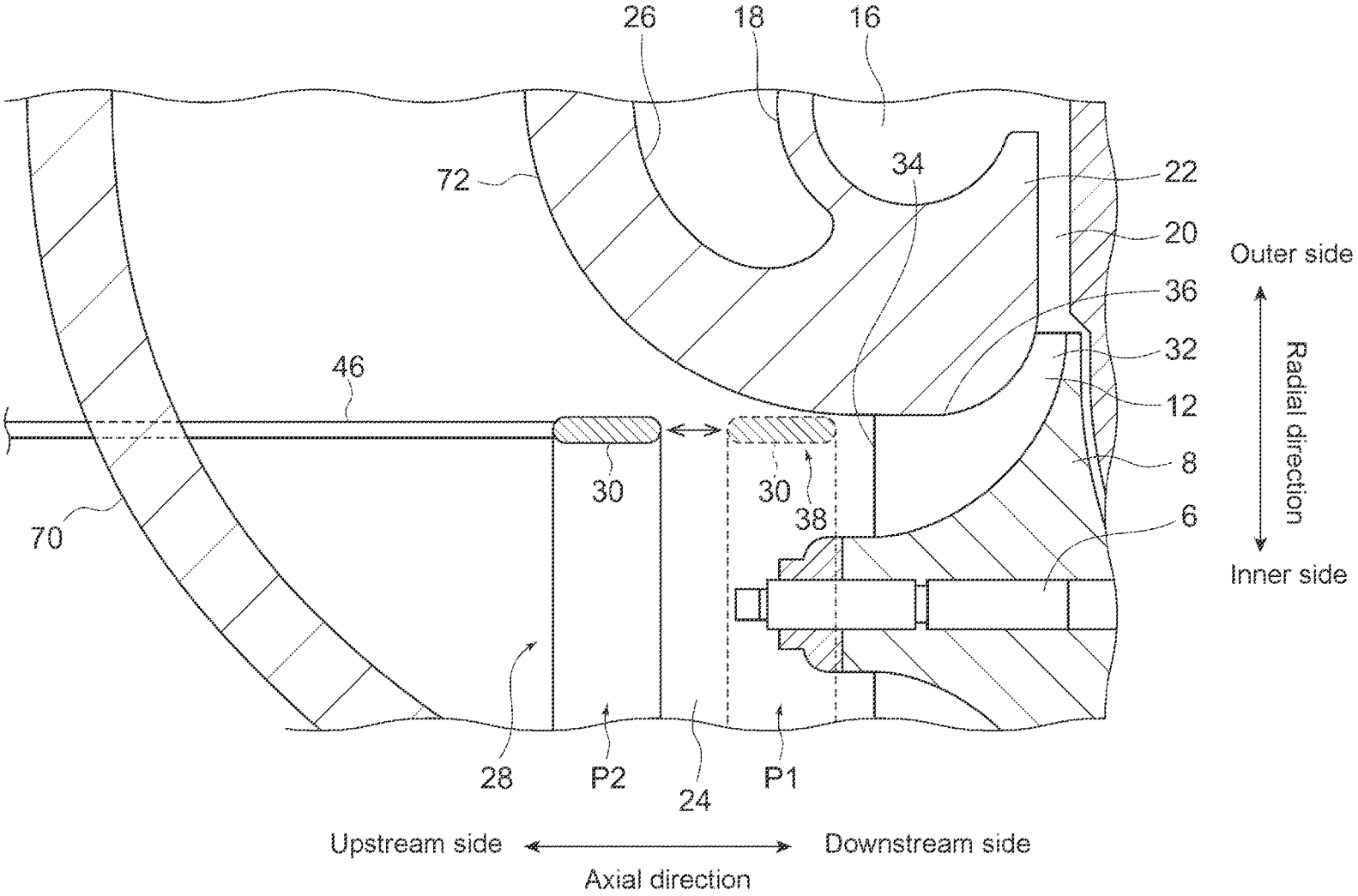
FIG. 15 is a schematic cross-sectional view of a centrifugal compressor according to a comparative embodiment.

In the embodiments shown in FIGS. 12 to 14, the strut 46 includes the outer extension portion 52 extending outward in the radial direction with an increase in distance from the annular portion 30. Thus, compared to the configuration according to the comparative embodiment shown in FIG. 15 (configuration in which the strut 46 extends upstream in the axial direction from the annular portion 30), the length of the strut 46 for connecting the annular portion 30 and the actuator (not shown) is reduced. As a result, the configuration can be simplified, and the increase in pressure loss due to the strut 46 in the intake passage 24 can be suppressed.

The present invention is not limited to the embodiments described above, but includes modifications to the embodiments described above, and embodiments composed of combinations of those embodiments.

For example, in the above-described embodiments, several shapes of the strut 46 for supporting the annular portion 30 have been described, but the shape of the strut is not limited thereto. In other words, the strut extends toward at least one of the outer side in the radial direction of the impeller or the downstream side in the axial direction of the impeller with an increase in distance from the annular portion. With this configuration, compared to the configuration in which the strut extends upstream in the axial direction from the annular portion, the length of the strut is reduced, so that the configuration can be simplified, and the increase in pressure loss due to the strut in the intake passage can be suppressed.

REFERENCE SIGNS LIST

2 Turbocharger
4 Centrifugal compressor
6 Rotational shaft
8 Impeller
10 Casing
12 Impeller housing space
14 Shroud wall portion
16 Scroll passage
18 Scroll portion
20 Diffuser passage
22 Diffuser portion
24 Intake passage
26 Inlet pipe portion
28 Throttle mechanism
30 Annular portion
32 Blade
34 Leading edge
36 Tip portion
38 Outer peripheral portion
40 Inner peripheral surface
42 Inclined surface
44 Outer peripheral surface
46 Strut
48 Actuator
49 Outer peripheral surface
50 Inclined surface
51 Downstream end
52 Outer extension portion
53 Radially outer end
54 Downstream extension portion
56 End surface
58 Curved portion
59 Downstream end
60 Passage extension portion
62 Leading edge portion
64 Trailing edge portion
66 Leading edge
68 Trailing edge
70 Bend pipe portion
72 Inner wall surface
74 Leading edge
76 Trailing edge
78 Flow passage portion
80, 82 Portion

The invention claimed is:

1. A centrifugal compressor, comprising: an impeller;
an inlet pipe portion forming an intake passage to introduce air to the impeller; and
a throttle mechanism capable of reducing a flow passage area of the intake passage upstream of the impeller,
wherein the throttle mechanism includes
an annular portion disposed in the intake passage, and
a strut supporting the annular portion and configured to move the annular portion between a first position and a second position upstream of the first position in an axial direction of the impeller, and
wherein the strut extends toward at least one of an outer side in a radial direction of the impeller or a downstream side in the axial direction of the impeller with an increase in distance from the annular portion,
wherein the strut includes an outer extension portion extending outward in the radial direction with an increase in distance from the annular portion,
wherein the outer extension portion includes a passage extension portion facing the intake passage, and
wherein, in a cross-section perpendicular to the radial direction, a straight line connecting a leading edge of the passage extension portion and a trailing edge of the passage extension portion is inclined downstream in a rotation direction of the impeller as going downstream in the axial direction.

2. The centrifugal compressor according to claim 1,
wherein, in a cross-section perpendicular to the radial direction, a>b is satisfied, where a is a distance between a leading edge of the passage extension portion and a trailing edge of the passage extension portion, and b is a thickness of the passage extension portion in a direction perpendicular to a straight line connecting the leading edge and the trailing edge.

3. The centrifugal compressor according to claim 1, wherein a thickness of a leading edge portion of the passage extension portion decreases upstream in the axial direction.

4. The centrifugal compressor according to claim 1, wherein a thickness of a trailing edge portion of the passage extension portion decreases downstream in the axial direction.

5. The centrifugal compressor according to claim 1, wherein the passage extension portion has an airfoil shape in a cross-section perpendicular to the radial direction.

6. The centrifugal compressor according to claim 1,
wherein the inlet pipe portion includes a bend pipe portion configured to bend a flow in the intake passage, and
wherein the strut is configured to move the annular portion between the first position and the second position along an inclination direction of an inner wall surface of the bend pipe portion.

7. The centrifugal compressor according to claim 1,
wherein the inlet pipe portion includes a bend pipe portion configured to bend a flow in the intake passage, and
wherein the annular portion is configured to be asymmetric with respect to a rotational axis of the impeller so as to bend along an inner wall surface of the bend pipe portion.

8. The centrifugal compressor according to claim 1,
wherein an inner peripheral surface of the inlet pipe portion includes an inclined surface that is inclined such that an inner diameter of the inlet pipe portion increases upstream in the axial direction.

9. The centrifugal compressor according to claim 8,
wherein an outer peripheral surface of the annular portion is separated from the inclined surface when the annular portion is in the second position, and
wherein a distance between the annular portion and the inclined surface decreases as the annular portion moves downstream in the axial direction from the second position.

10. The centrifugal compressor according to claim 8,
wherein an outer peripheral surface of the inlet pipe portion includes an inclined surface that is inclined such that an outer diameter of the inlet pipe portion increases upstream in the axial direction.

11. The centrifugal compressor according to claim 10,
wherein the strut includes a downstream extension portion extending downstream in the axial direction with an increase in distance from the annular portion.

12. The centrifugal compressor according to claim 11, wherein the strut extends to a position between the inclined surface of the outer peripheral surface of the inlet pipe portion and a diffuser portion of the centrifugal compressor, or to a position between the inclined surface of the outer peripheral surface of the inlet pipe portion and a scroll portion of the centrifugal compressor.

13. A centrifugal compressor, comprising:

an impeller;

an inlet pipe portion forming an intake passage to introduce air to the impeller; and a throttle mechanism capable of reducing a flow passage area of the intake passage upstream of the impeller, wherein the throttle mechanism includes an annular portion disposed in the intake passage, and a strut supporting the annular portion and configured to move the annular portion between a first position and a second position upstream of the first position in an axial direction of the impeller, and wherein the strut extends toward at least one of an outer side in a radial direction of the impeller or a downstream side in the axial direction of the impeller with an increase in distance from the annular portion, wherein the strut includes an outer extension portion extending outward in the radial direction with an increase in distance from the annular portion, wherein the outer extension portion includes a passage extension portion facing the intake passage, and wherein, in a cross-section perpendicular to the radial direction, when CL is a center line connecting a leading edge of the passage extension portion and a trailing edge of the passage extension portion and passing through a center position of a thickness of the passage extension portion, an angle between the center line CL and the axial direction at a position of the trailing edge of the passage extension portion is greater than an angle between the center line CL and the axial direction at a position of the leading edge of the passage extension portion.

14. A centrifugal compressor, comprising:

an impeller;

an inlet pipe portion forming an intake passage to introduce air to the impeller; and a throttle mechanism capable of reducing a flow passage area of the intake passage upstream of the impeller, wherein the throttle mechanism includes an annular portion disposed in the intake passage, and a strut supporting the annular portion and configured to move the annular portion between a first position and a second position upstream of the first position in an axial direction of the impeller, and wherein the strut extends toward at least one of an outer side in a radial direction of the impeller or a downstream side in the axial direction of the impeller with an increase in distance from the annular portion, wherein the strut includes an outer extension portion extending outward in the radial direction with an increase in distance from the annular portion, wherein the outer extension portion includes a passage extension portion facing the intake passage, and wherein, in a cross-section perpendicular to the radial direction, when CL is a center line connecting a leading edge of the passage extension portion and a trailing edge of the passage extension portion and passing through a center position of a thickness of the passage extension portion, an angle between the center line CL and the axial direction at a position of the trailing edge of the passage extension portion is smaller than an angle between the center line CL and the axial direction at a position of the leading edge of the passage extension portion.

15. A turbocharger, comprising the centrifugal compressor according to claim 1.

* * * * *